US010987716B2

(12) United States Patent
Nijuri et al.

(10) Patent No.: US 10,987,716 B2
(45) Date of Patent: Apr. 27, 2021

(54) PRESS DIE

(71) Applicant: SUBARU CORPORATION, Tokyo (JP)

(72) Inventors: Kazuhiko Nijuri, Tokyo (JP); Hidekazu Okabe, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 232 days.

(21) Appl. No.: 16/406,056

(22) Filed: May 8, 2019

(65) Prior Publication Data

US 2019/0366412 A1 Dec. 5, 2019

(30) Foreign Application Priority Data

May 31, 2018 (JP) ..... JP2018-104396

(51) Int. Cl.
*B21D 28/02* (2006.01)
*B21D 28/26* (2006.01)

(52) U.S. Cl.
CPC ..... *B21D 28/26* (2013.01); *B21D 28/02* (2013.01)

(58) Field of Classification Search
CPC ..... B21D 28/00; B21D 28/02; B21D 45/00; B21D 24/16; B21J 5/027; B30B 15/32
USPC ..... 72/332, 324, 338
See application file for complete search history.

(56) References Cited

U.S. PATENT DOCUMENTS

2010/0199739 A1* 8/2010 Thaddaeus ..... B21D 24/16 72/328
2014/0102273 A1* 4/2014 Moore ..... B26D 7/0641 83/23

FOREIGN PATENT DOCUMENTS

JP 2002-192270 7/2002
JP 2002192270 A * 7/2002 ..... B21D 45/00
JP 2017056473 A * 3/2017 ..... B21D 24/16

OTHER PUBLICATIONS

Ishizaka, Translation of JP-2002192270 (Year: 2002).*
Yoshida, Translation of JP-2017056473 (Year: 2017).*

* cited by examiner

*Primary Examiner* — Adam J Eiseman
*Assistant Examiner* — Bobby Yeonjin Kim
(74) *Attorney, Agent, or Firm* — Smith, Gambrell & Russell, LLP

(57) ABSTRACT

A press die includes a fixed die, a first movable die, and a second movable die to cut out a product from a metal plate member, and a scrap cutter to cut scrap that is not part of the product. A fixed-die cutting blade of the fixed die is configured to have a fixed-die cutting blade relief portion formed near a base end of the protruding scrap cutter and recessed inward to the product side from the cutting line of the product. The fixed-die cutting blade relief portion includes a substantially arc-shaped cross-sectional portion corresponding to a machining radius of a machining tool for forming the scrap cutter. A first movable-die cutting blade of the first movable die has a movable-die cutting blade protrusion to cut the metal plate member inward to the product side from the cutting line of the product.

3 Claims, 6 Drawing Sheets

PRESS DIE

CROSS-REFERENCE TO RELATED APPLICATIONS

The present application claims priority from Japanese Patent Application No. 2018-104396 filed on May 31, 2018, the entire contents of which are hereby incorporated by reference.

BACKGROUND

The disclosure relates to a press die, and more particularly to a press die having a scrap cutter for cutting out a product from a metal plate member and for cutting scrap that is not part of the product, the press die having a fixed die, a first movable die, and a second movable die.

Metal plate members used in vehicles are formed by a pressing process using a press die, and in the pressing process, a product cutting-out process, which is generally called as trimming, is performed (herein, the metal plate member cut out is referred to as a product). The cutting-out process of the product is performed by shearing a metal plate member with a fixed-die cutting blade of a fixed die (generally, a bottom die) and a movable-die cutting blade of a movable die (generally, a top die). The movable die may be divided into a plurality of parts, such as a first movable die and a second movable die.

Parts other than the product, being produced by the cutting out process with this press die, are referred to as scrap. Such scrap generally corresponds to a peripheral edge portion of the metal place member before cutting. When the scrap corresponding to the peripheral edge portion of the metal plate member is not cut and remains connected, it is difficult to remove the scrap from the press machine. Therefore, the scrap is cut by the scrap cutter at the same time the product is cut out by the press die, thereby facilitating removal of the scrap from the press machine. The scrap cut by the scrap cutter in this manner is removed from the press by sliding down a scrap chute, such as the scrap chute described in Japanese Unexamined Patent Application Publication (JP-A) No. 2002-192270, for example.

The scrap cutter has a scrap-cutting blade, and the scrap is cut by a shearing process with the movable-die scrap-cutting blade of the movable die. Further, the scrap cutter is provided on a base which is separated from the fixed die.

SUMMARY

An aspect of the disclosure provides a press die. The press die includes a fixed die, a first movable die, a second movable die, and a scrap cutter. The fixed die, the first movable die, and the second movable die are configured to cut out a product from a metal plate member. The scrap cutter is configured to cut scrap that is not part of the product. The scrap cutter and the fixed die are integrally formed in a cantilever manner in a substantially horizontal direction from the fixed die. The scrap cutter includes a scrap-cutting blade configured to cut the scrap. The fixed die includes a fixed-die cutting blade configured to cut the metal plate member at a predetermined cutting line of the product. The first movable die includes a first movable-die cutting blade configured to cut the metal plate member at a cutting line of the product by a shearing process with the fixed-die cutting blade, and a movable-die scrap-cutting blade configured to cut the scrap by a shearing process with the scrap-cutting blade. The second movable die includes a second movable-die cutting blade configured to cut the metal plate member at the cutting line of the product by a shearing process with the fixed-die cutting blade. The fixed-die cutting blade is configured to have a fixed-die cutting blade relief portion formed near a base end of the protruding scrap cutter and recessed inward to the product side from the cutting line of the product. The fixed-die cutting blade relief portion includes a substantially arc-shaped cross-sectional portion corresponding to a machining radius of a machining tool for forming the scrap cutter. The first movable-die cutting blade includes a movable-die cutting blade protrusion configured to cut the metal plate member inward to the product side from the cutting line of the product by a shearing process with the fixed-die cutting blade relief portion.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
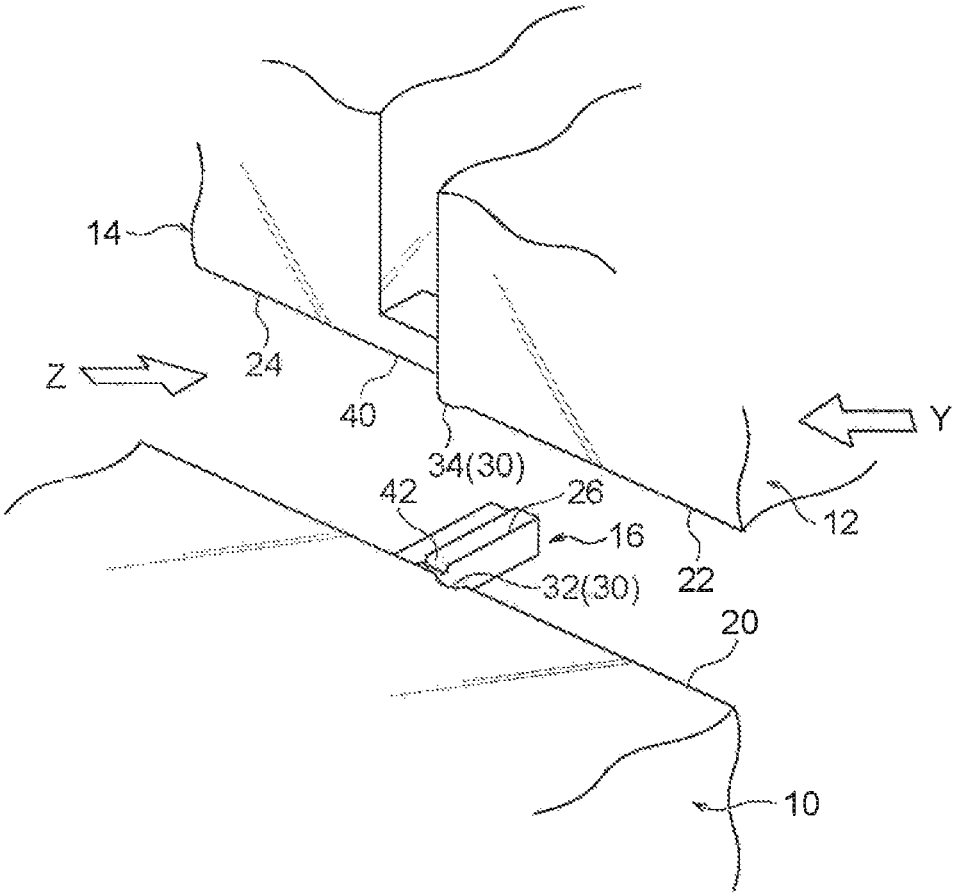
FIG. 1 is a perspective view illustrating a main part of an embodiment of a press die of the disclosure.

In the following, a preferred but non-limiting embodiment of the disclosure is described in detail with reference to the accompanying drawings. Note that sizes, materials, specific values, and any other factors illustrated in the embodiment are illustrative for easier understanding of the disclosure, and are not intended to limit the scope of the disclosure unless otherwise specifically stated. Further, elements in the following example embodiment which are not recited in a most-generic independent claim of the disclosure are optional and may be provided on an as-needed basis. Throughout the present specification and the drawings, elements having substantially the same function and configuration are denoted with the same reference numerals to avoid any redundant description. Further, elements that are not directly related to the disclosure are unillustrated in the drawings. The drawings are schematic and are not intended to be drawn to scale. Since the conventional scrap cutter is provided on a base separated from the fixed die, the base and the cut scrap may interfere with each other, thereby making it difficult to remove the scrap from the press.

It is desirable to provide a press die capable of smoothly ejecting scrap without a separate base on which to provide a scrap cutter.

Figure 2:
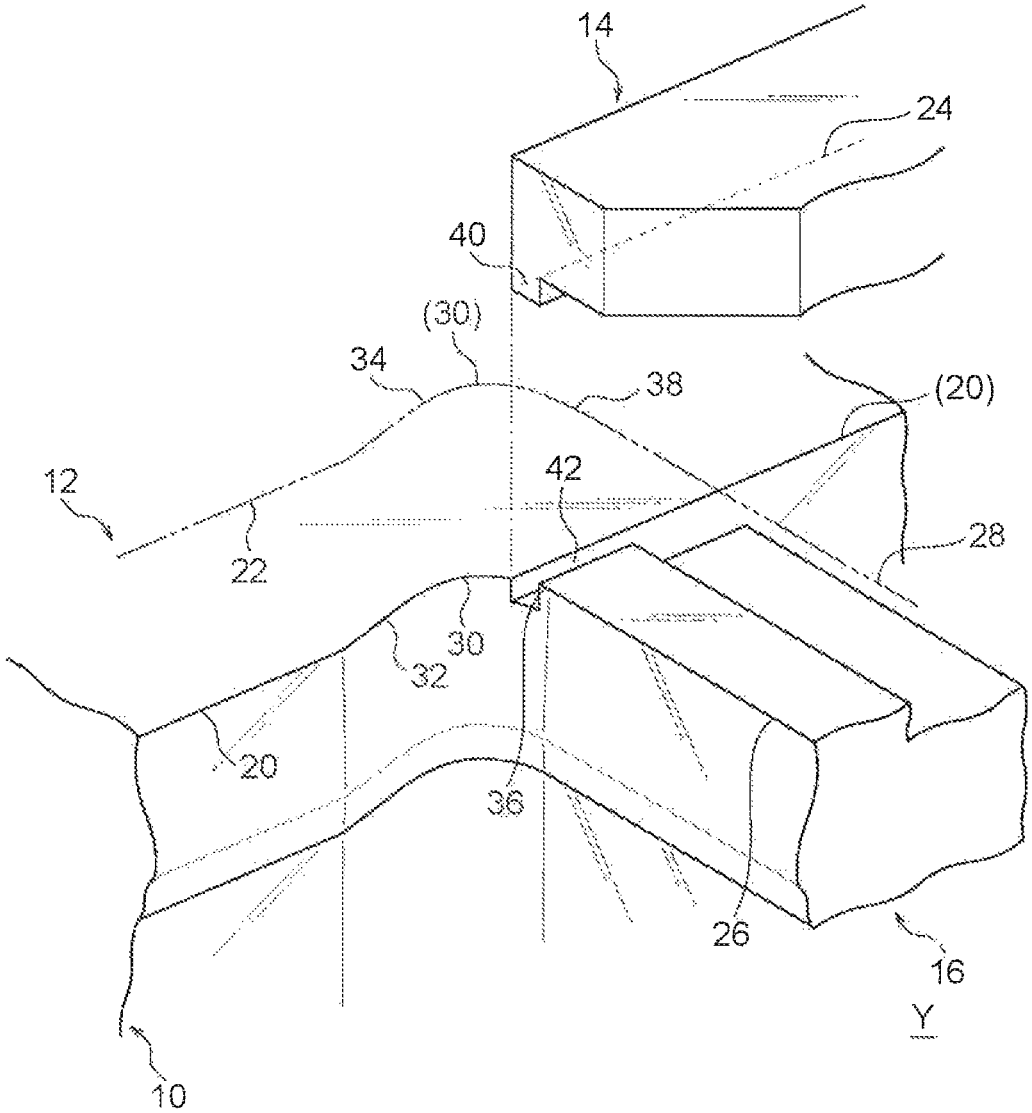
FIG. 2 is a detailed view of the press die of FIG. 1 as viewed from the direction indicated by the arrow Y.
Figure 3:
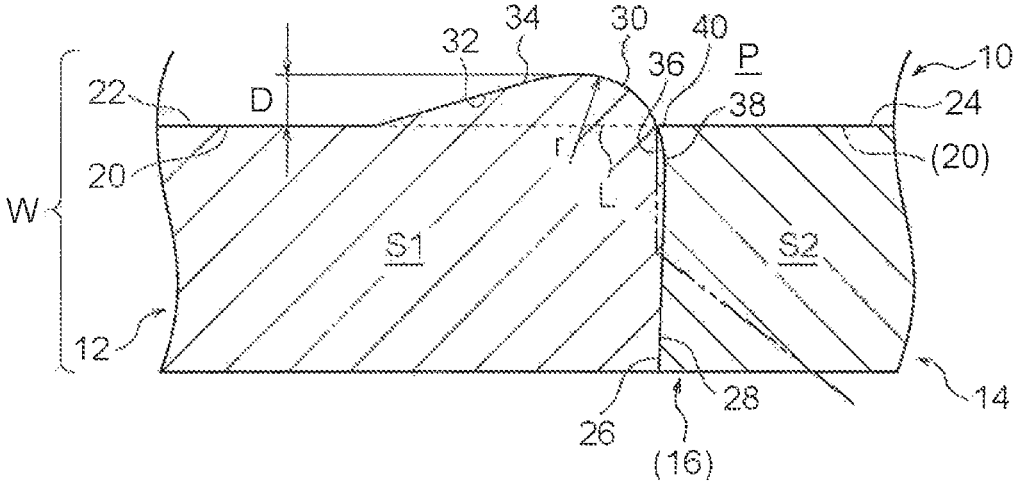
FIG. 3 is a plan view of a metal plate member cut by the press die of FIG. 1.
Figure 6:
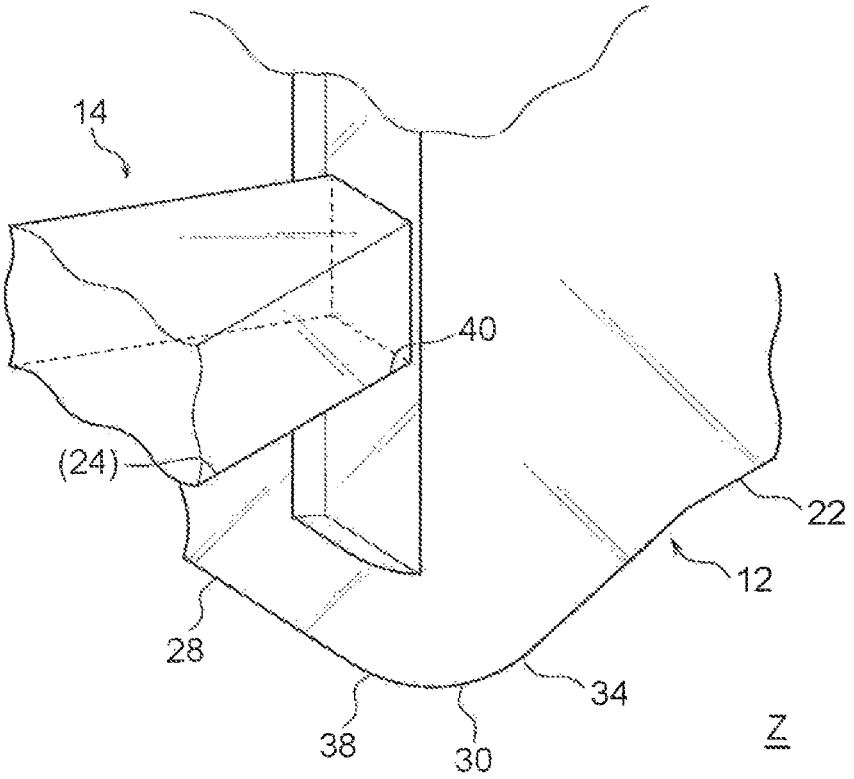
FIG. 6 is a detailed view of the press die of FIG. 1 as viewed from the direction indicated by the arrow Z.

FIG. 1 is a perspective view illustrating a main part of an embodiment of the press die of the disclosure, FIG. 2 is a detailed view of the press die of FIG. 1 as viewed along the Y-arrow, and FIG. 3 is a plan view of a metal plate member W cut by the press die of FIG. 1. FIG. 6 is a detailed view of the press die of FIG. 1 viewed along the arrow Z to illustrate a structure for avoiding interference between a movable-die cutting-blade extension and the scrap-cutting blade, as will be described later. Hereinafter, in the plan view of the metal plate member W, reference numerals for each die of the press die and the cutting blade are shown together. The press die of this embodiment includes a fixed die 10 constituting a so-called bottom die, and a first movable die 12 and a second movable die 14 constituting a top die. In FIG. 2, only the cutting blade of the first movable die 12 is illustrated with a two-dot chain line to facilitate understanding. This press die is for cutting out a product P by a process generally known as trimming; the fixed die 10 has a fixed-die cutting blade 20, the first movable die 12 has a first movable-die cutting blade 22, the second movable die 14 has a second movable-die cutting blade 24; and the product P is cut out from the metal plate member W by a shearing process of the fixed-die cutting blade 20, the first movable-die cutting blade 22, and the second movable-die cutting blade 24.

In the present embodiment, the metal plate member W, which is cut out by the fixed-die cutting blade 20 of the fixed die 10, the first movable-die cutting blade 22 of the first movable die 12, and the second movable-die cutting blade 24 of the second movable die 14, is defined as the product P.

In this embodiment, by means of a mechanism (not shown) using, for example, a spring, a cam, or the like, or a cylinder driven by a separate source of energy, the first movable die 12, which is a top die, descends with respect to the fixed die 10, which is a bottom die, and then the second movable die 14 descends. That is, in this embodiment, after the metal plate member W is cut by the shearing process of the fixed-die cutting blade 20 of the fixed die 10 and the first movable-die cutting blade 22 of the first movable die 12, the product P is cut out by the shearing process of the fixed-die cutting blade 20 of the fixed die 10 and the second movable-die cutting blade 24 of the second movable die 14. At this time, as will be described later, the scraps S1 and S2 are cut by the scrap cutter 16 at the same time as or slightly later than the cutting of the metal plate member W with the fixed-die cutting blade 20 and the first movable-die cutting blade 22. It should be noted that the illustrated product example is merely an example, and the press die of this embodiment can be applied to any desired product shape. Also, as will be appreciated by those skilled in the art, the drawings are exaggerated in size and the actual dimensions are much smaller than those shown. Further, the actual cutting blade needs to be set to a microscopic clearance angle, or the like, or a microscopic clearance dimension, or the like, but such a microscopic angle or dimension is also omitted.

In the press die of this embodiment, the scrap cutter 16 is formed integrally with the fixed die 10, with protruding in a cantilever manner in a substantially horizontal direction from the fixed die 10. In this embodiment, the scrap cutter 16 is formed integrally with the fixed die 10 and protrudes from the fixed die 10, thereby eliminating a separate base for supporting a conventional scrap cutter 16. When the scrap cutter 16 is formed integrally with the fixed die 10 in this manner, the fixed die 10 and the scrap cutter 16 are formed by a so-called machining process from a fixed blank (material) that includes a scrap cutter forming portion. The fixed die 10 and the scrap cutter 16 are usually formed by milling or the like, and an end mill, for example, is used as the machining tool for the milling. As is well known, an end mill can be operated with a plane cutting blade at the axial end or with a circular arc cross section with a radially outer (i.e., lateral) cutting blade. The scrap cutter 16 of this embodiment is cut by, for example, a lateral cutting blade of the end mill. The machining radius of an arc cross section (including a substantially arc cross section) by the lateral cutting blade of the end mill is defined as the machining radius r.

As described above, the scrap cutter 16 is for further cutting scrap other than parts of the product P of the metal plate member W to be cut. Therefore, for example, in FIG. 2, a scrap-cutting blade 26 for cutting the scraps S1 and S2 is formed at the upper left corner edge of the scrap cutter 16 illustrated in the drawing. The first movable die 12 has a movable-die scrap-cutting blade 28 for cutting the scraps S1 and S2 by a shearing process with the scrap-cutting blade 26. Therefore, when the first movable die 12, which is the top die, moves downward in the drawing with respect to the fixed die 10, which is the bottom die, the metal plane member W is sheared by the scrap-cutting blade 26 and the movable-die scrap-cutting blade 28, and the scrap corresponding portion of the metal place member W is cut. The scraps S1 and S2 mainly consist of a peripheral portion of the metal plate member W, but since the so-called excess of the metal plate member W, which is not part of the product P, is made as small as possible, the scrap-cutting blade 26 and the movable-die scrap-cutting blade 28 for cutting the excess are not so long.

In this embodiment, the fixed-die cutting blade 20 of the fixed die 10 and the first movable-die cutting blade 22 of the first movable die 12 are set so as to cut the product P at the predetermined cutting line L of the product P. Similarly, the fixed-die cutting blade 20 of the fixed die 10 and the second movable-die cutting blade 24 of the second movable die 14 are also set so as to cut the product P at the predetermined cutting line L of the product P. At the same time, as described above, when the scrap cutter 16 is formed by machining with a machining tool, an arc cross-sectional portion (including a substantially arc cross-sectional portion) 30 corresponding to the machining radius r of the machining tool is formed at or near the base end of the protruding scrap cutter 16. Therefore, in this embodiment, a fixed-die cutting blade relief portion 32 including the arc cross-sectional portion 30 corresponding to the machining radius r of the machining tool is formed inside the product P from the cutting line L, that is, in the fixed-die cutting blade 20 in the vicinity of the base end of the protruding scrap cutter 16 so as to be recessed in fixed die 10. The first movable-die cutting blade 22 has a movable-die cutting blade protrusion 34 that protrudes into the product P from the cutting line L, that is, protrudes from the first movable die 12 so as to cut the metal plate member W by the shearing process with the fixed-die cutting blade relief portion 32.

Accordingly, in the product P, a recessed portion including the arc cross-sectional portion 30 corresponding to the machining radius r of the machining tool is formed, by the shearing process of the fixed-die cutting blade relief portion 32 and the movable-die cutting blade protrusion 34 so as to be recessed inward from the cutting line L of the product P. Among the recessed portions, the portion recessed into the product P from the cutting line L is the arc cross-sectional portion 30 corresponding to the machining radius r of the machining tool. As long as the dimension D of the arc cross-sectional portion 30 from the cutting line L of the product P is set to within an allowable range of the cutting position of the product P, that is, within a so-called tolerance, even if a recessed portion including the arc cross-sectional portion 30 is generated in the product P, there are no problems with the cutting accuracy of the product P. It should be noted that the recessed portion formed in the product P by the shearing process of the fixed-die cutting blade relief portion 32 and the movable-die cutting blade protrusion 34 may consist of only the arc cross-sectional portion 30 corresponding to the machining radius r of the machining tool.

Figure 4:
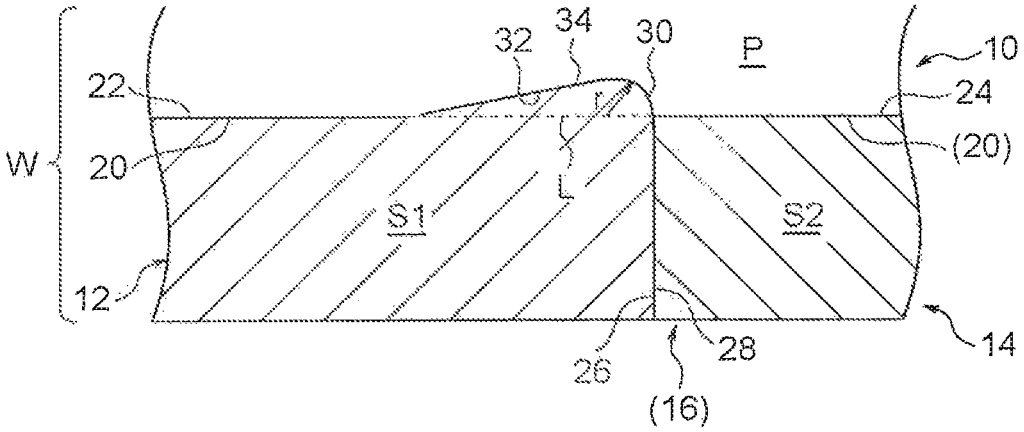
FIG. 4 is a plan view of a metal plate member cut in a modification of the press die of FIG. 1.

In theory, it is also possible to make the arc cross-sectional portion 30 corresponding to the machining radius r of the machining tool fit completely inside the product P and not protrude to the scraps S1 and S2 side, as can be seen, for example, in the modification illustrated in FIG. 4. If it is possible to set the recessed portion including the arc cross-sectional portion 30 corresponding to the machining radius r of the machining tool in the manner described above, the cutting line L of the remaining product P can be cut by the shearing process of the fixed-die cutting blade 20 and the second movable-die cutting blade 24. In this case, it is unnecessary to extend the second movable-die cutting blade 24, and the blade strength of the second movable-die cutting blade 24 can be ensured.

However, as clearly shown in FIG. 3, the arc cross-sectional portion 30 corresponding to the machining radius r of the above-mentioned machining tool often protrudes to the scrap S2 side, that is, to the scrap-cutting blade 26 side. In this case, the scrap-cutting blade 26 has a scrap-cutting blade R-portion (rounded portion) 36 corresponding to the arc cross-sectional portion 30. In accordance with this, the movable-die scrap-cutting blade 28 has a movable-die scrap-cutting blade R-portion 38 which cuts the arc cross-sectional portion 30 in the portion corresponding to the scrap S2 by a shearing process with the scrap-cutting blade R-portion 36. In this case, as shown in FIG. 4, unless the second movable-die cutting blade 24 extends only to the position of the scrap-cutting blade 26, a part of the arc cross-sectional portion 30 corresponding to the machining radius r of the machining tool will remain. Therefore, the second movable-die cutting blade 24 is extended (i.e., protruded) toward the movable-die scrap-cutting blade 28 to form the movable-die cutting blade extension 40 so as to cut the arc cross-sectional portion 30 corresponding to the machining radius r of the machining tool by the shearing process with the fixed-die cutting blade 20.

When the second movable-die cutting blade 24 is extended to form the movable-die cutting blade extension 40 in this manner, as can be inferred from the plan view of FIG. 3, the movable-die scrap-cutting blade 28 of the first movable die 12 and the movable-die scrap-cutting blade R-portion 38 described above interfere with the movable-die cutting blade extension 40. In this embodiment, as described above, the first movable die 12 moves down first with respect to the fixed die 10, and then the second movable die 14 moves down. Therefore, in this embodiment, as shown in FIG. 6, a portion that interferes with the first movable die 12 is removed when the movable-die cutting blade extension 40 is lowered, and after the movable-die scrap-cutting blade 28 cuts the metal plate member W by the shearing process with the scrap-cutting blade 26, the movable-die cutting blade extension 40 can cut the metal plate member W by the shearing process with the fixed-die cutting blade 20.

Further, in this embodiment, as clearly shown in FIG. 2, at least the cutting blade portion of the movable cutting blade extension 40 of the second movable-die cutting blade 24 is made to protrude to the fixed die 10 side beforehand, and thus, the scrap cutter 16 has an accommodating recess 42 in which the protrusion of the movable-die cutting blade extension 40, protruding toward the fixed die 10 side, is accommodated in case of shearing with the fixed die 10 by the second movable die 14. When the metal plate member W is cut by the shearing process of the movable-die cutting blade extension 40 of the second movable-die cutting blade 24 and the fixed-die cutting blade 20, as is understood from FIG. 3, the movable-die cutting blade extension 40 protrudes toward the scrap-cutting blade 26 of the scrap cutter 16. In order to avoid interference with the protrusion of the movable-die cutting blade extension 40, the interfering portion of the scrap-cutting blade 26 must be removed. However, since the scrap-cutting blade 26 has to cut the scraps S1 and S2 of the metal plate member W by the shearing process with the movable-die scrap-cutting blade 28, the portion to be removed from the cutting blade should be small.

Therefore, in this embodiment, only the cutting blade of the movable-die cutting blade extension 40 of the second movable-die cutting blade 24 protrudes toward the fixed die 10 side beforehand, and the accommodating recess 42 in which the protrusion is accommodated is formed in the portion that would interfere with the protrusion, thereby avoiding interference and minimizing the portion to be removed in the scrap-cutting blade 26. As a result, it is possible to secure the blade length of the scrap-cutting blade 26, and at the same time, it is possible to ensure the blade strength of the scrap-cutting blade 26. Further, by doing so, the arc cross-sectional portion 30 corresponding to the processing radius r of the machining tool of the scrap S2 cut by the shearing processing of the movable-die cutting blade extension 40 and the fixed-die cutting blade 20 descends into the accommodation recess 42, and interference between the scrap S2 and the scrap cutter 16 is avoided.

Figure 5:
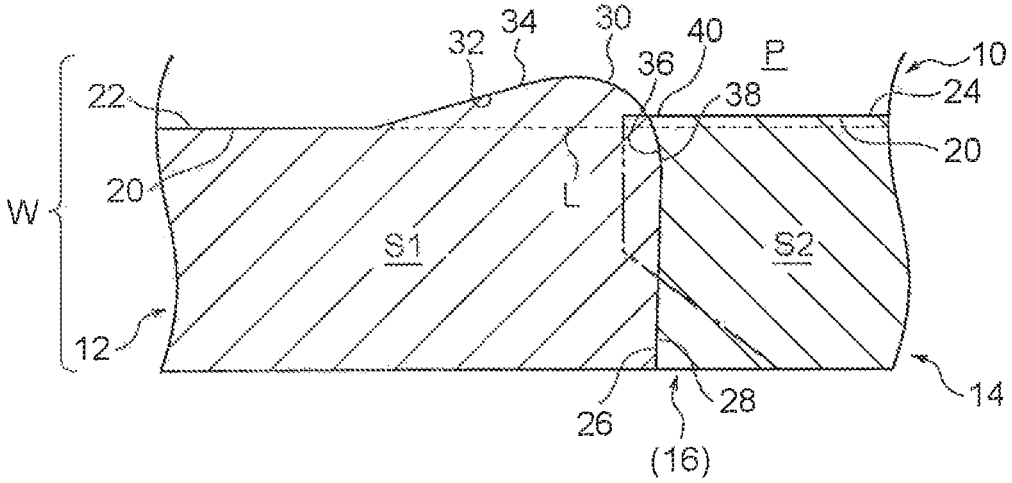
FIG. 5 is a plan view of a metal plate member cut in a further modification of the press die of FIG. 1.

In this embodiment, as is clear from FIG. 3, the protruding tip corner of the movable-die cutting blade extension 40 is made to coincide with the intersection of the fixed-die cutting blade relief portion 32 and the fixed-die cutting blade 20, thereby minimizing the protruding dimension of the movable-die cutting blade extension 40 toward the movable-die scrap-cutting blade 28, as described above. However, as a result of this, in the case where the blade strength of the movable-die cutting blade extension 40 becomes insufficient, as shown in the plan view of the further modified example of FIG. 5, the protrusion dimension of the movable-die cutting blade extension 40 toward the movable-die scrap-cutting blade 28 side may be increased. Further, as shown in the same figure, it is also possible to set the cutting line of the metal plate member W by the shearing process of at least the movable-die cutting blade extension 40 of the second movable-die cutting blade 24 (in the figure, the entire second movable-die cutting blade 24) with the fixed-die cutting blade 20 to the cutting line of the metal plate member W by the shearing process of the first movable-die cutting blade 22 and the fixed-die cutting blade 20, that is, on the side of the cutting line L inward into the product P.

Figure 8:
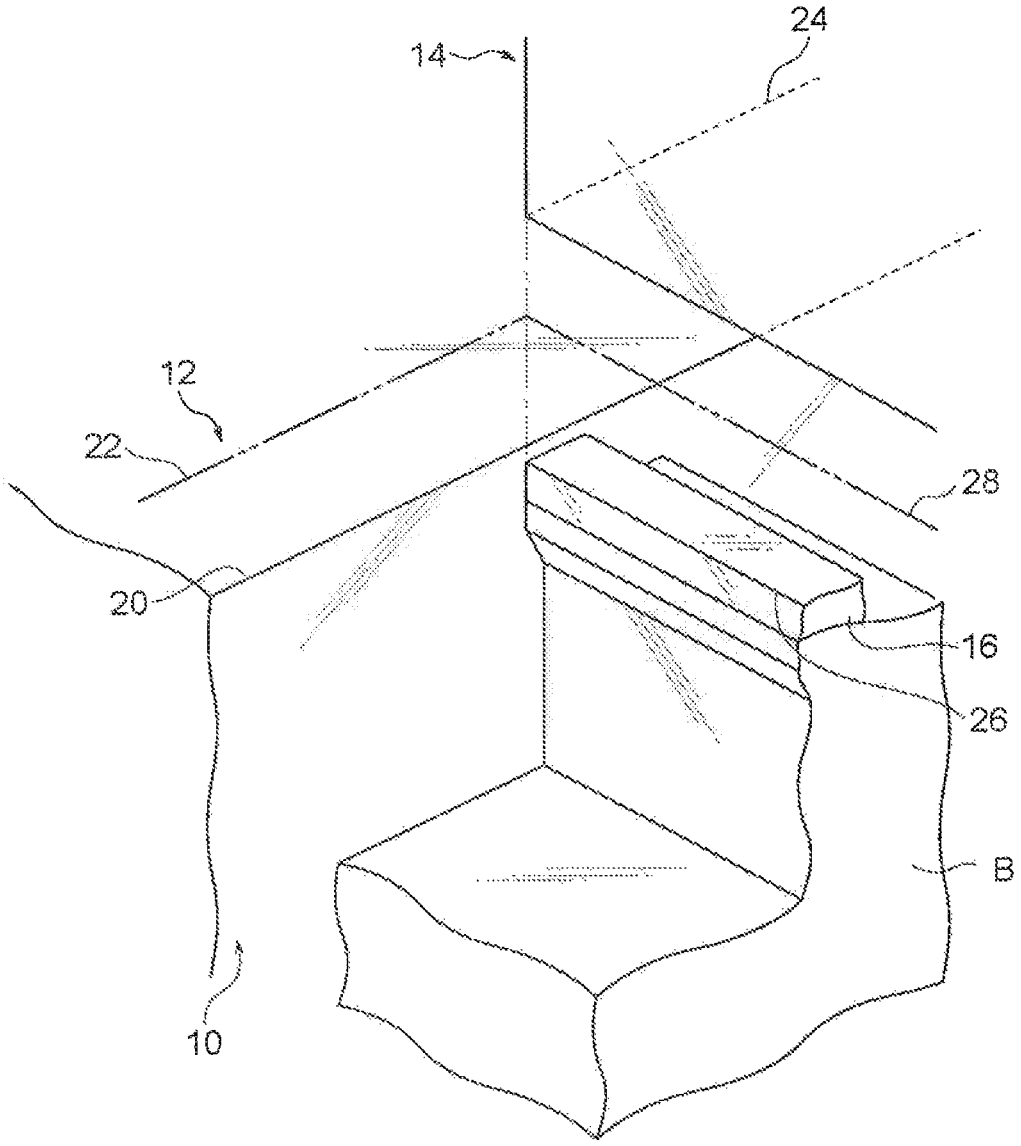
FIG. 8 is a perspective view illustrating a main part of a conventional press die.
Figure 9:
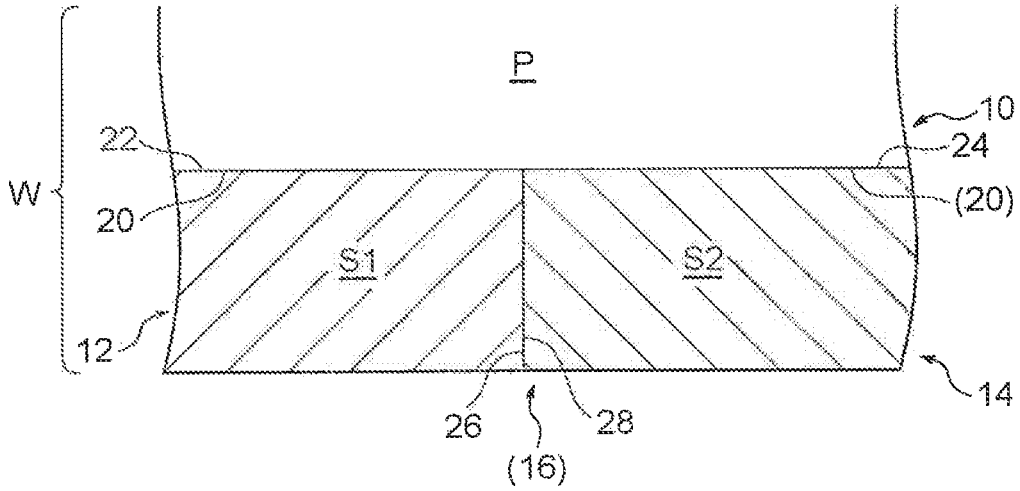
FIG. 9 is a plan view of a metal plate member cut by the press die of FIG. 8.

Next, the operation and effect of the press die of this embodiment will be described in order from the conventional press die. FIG. 8 is a perspective view illustrating a main part of a conventional press die, and FIG. 9 is a plan view of a metal plate member W cut by the press die of FIG. 8. In this conventional press die, the product P is cut out by a shearing process of the fixed die 10 as the bottom die and the first movable die 12 and the second movable die 14 as the top die, and the scraps S1 and S2 are cut by the scrap cutter 16. Similarly to FIG. 2, only the cutting blades of the first movable-die cutting blade 22 and the movable-die scrap-cutting blade 28 of the first movable die 12 are illustrated by a two-dot chain line. The order of cutting the product P and cutting the scraps S1 and S2 by a shearing process of the fixed die 10, the first movable die 12, and the second movable die 14 is also the same as in the embodiment of FIG. 2.

In this conventional press die, the scrap cutter 16 is provided on a base B separated from the fixed die 10. The scrap cutter 16 has, for example, a straight scrap-cutting blade 26, and the first movable die 12 has, for example, a movable scrap-cutting blade 28 that cuts the scraps S1 and S2 by a shearing process with the scrap-cutting blade 26. In this conventional press die, similarly to the press die of the embodiment of FIG. 2, the metal plate member W is cut at the cutting line L of the product P by a shearing process of the fixed-die cutting blade 20 of the fixed die 10 and the first movable-die cutting blade 22 of the first movable die 12, and at the same time, the scrap portion of the metal plate member W is cut by a shearing process of the scrap-cutting blade 26 of the scrap cutter 16 with the movable-die scrap-cutting blade 28 of the first movable die 12. Thereafter, the product P is cut out at the cutting line L of the product P by the shearing process of the fixed-die cutting blade 20 of the fixed die 10 with the second movable-die cutting blade 24 of the second movable die 14.

At this time, the scrap S1 generated by the scrap-cutting blade 26 of the scrap cutter 16 and the movable-die scrap-cutting blade 28 of the first movable die 12 descends to the left of the base B in the drawing, and the scrap S2 generated by cutting out the product P descends to the right of the base B in the drawing. In this example, since the base B on which the scrap cutter 16 is mounted is connected to the base of the press illustrated on the left side of FIG. 8, the scrap S1 descending to the left of the base B may interfere with the base B and thus may not be removed smoothly from the press.

Figure 7:
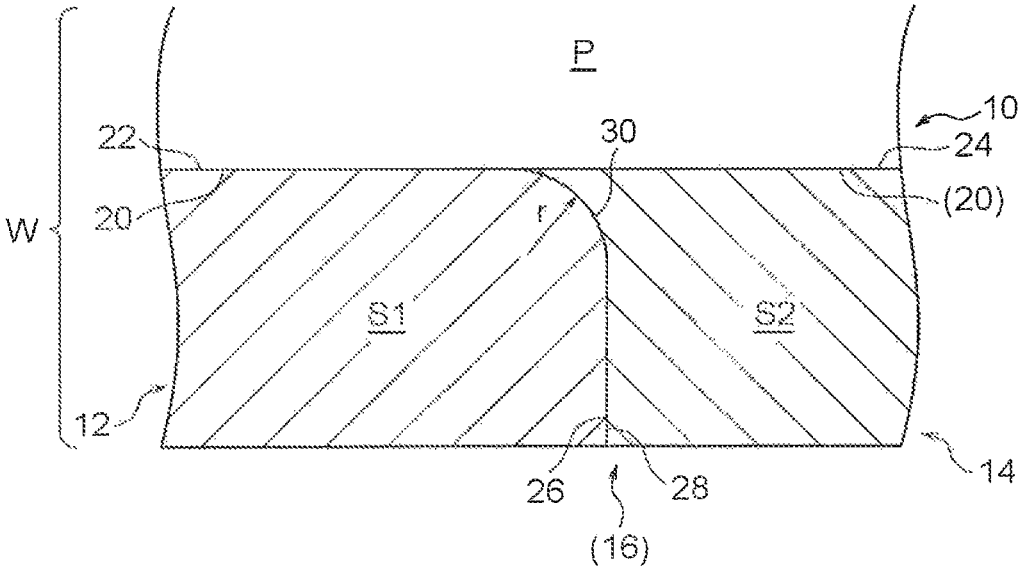
FIG. 7 is a plan view of a metal plate member cut in a comparative example of the press die of the disclosure.

Therefore, as shown in the embodiment of FIG. 2, in order to eliminate the base B for providing the scrap cutter 16, the scrap cutter 16 is formed integrally with the fixed die 10 in a cantilever shape in a substantially horizontal direction from the fixed die 10. When the scrap cutter 16 is formed integrally with the fixed die 10 so as to protrude from the fixed die 10 by using the above-mentioned end mill as a machining tool, for example, as shown in FIG. 7, an arc cross-sectional portion (including a substantially arc-shaped cross-sectional portion) 30 corresponding to the machining radius r of the machining tool is formed in the scrap-cutting blade 26 at the base end of the protruding scrap cutter 16. If the scraps S1 and S2 are cut by the movable-die scrap-cutting blade 28 of the first movable die 12 while the arc cross-sectional portion 30 remains in the scrap-cutting blade 26, an arc cross-sectional portion 30 is also necessary for the movable-die scrap-cutting blade 28.

When the metal plate member W is cut by the shearing process of the scrap-cutting blade 26 including the arc cross-sectional portion 30 and the movable-die scrap-cutting blade 28 configured as described above, the portion corresponding to the arc cross-sectional portion 30 remains as it is on the metal plate member W as a portion of the scrap S2. When the second movable-die cutting blade 24 is extended toward the movable-die scrap-cutting blade 28 while avoiding interference with the movable-die scrap-cutting blade 28 to cut the portion of the scrap S2 corresponding to the arc cross-sectional portion 30 by the shearing process of the second movable-die cutting blade 24 with the fixed-die cutting blade 20, the extended dimension is large and the protruding tip of the extended portion is sharpened so as to enter a gap formed with the first movable die 12. If the protruding tip of the extended portion of the movable-die scrap-cutting blade 24 becomes sharp as described above, the blade strength may not be ensured.

On the other hand, in the press die of this embodiment, in addition to the fixed-die cutting blade 20 having the fixed-die cutting blade relief portion 32, the first movable-die cutting blade 22 has the movable-die cutting blade protrusion 34 for cutting the metal plate member W by the shearing process with the fixed-die cutting blade relief portion 32 so that the arc cross-sectional portion 30, corresponding to the machining radius r of the machining tool for forming the scrap cutter 16 integrally with the fixed die 10, is recessed inward from the cutting line L of the product P. Accordingly, by the shearing process of the fixed-die cutting blade relief portion 32 with the movable-die cutting blade protrusion 34, the arc cross-sectional portion 30 corresponding to the machining radius r of the machining tool is formed inside the product P with respect to the cutting line L of the product P, and the arc cross-sectional portion 30 corresponding to the machining radius r of the machining tool is not formed in the scrap-cutting blade 26 of the scrap cutter 16, as shown in FIG. 4, or is only formed to be small, as shown in FIG. 3. In either case, by setting the dimension D from the cutting line L of the product P of the arc cross-sectional portion 30, which is inside the product P with respect to the cutting line L of the product P, in accordance with the machining radius r of the machining tool within an allowable range (tolerance) set in advance from the cutting line L of the product P, there is no problem in the cutting accuracy of the product P.

When the substantially arc-shaped cross-sectional portion 30 corresponding to the machining radius r of the machining tool is not formed in the scrap-cutting blade 26, after the shearing process of the fixed-die cutting blade 20 with the first movable-die cutting blade 22, the metal plate member W can be cut at the cutting line L of the product P by the shearing process of the fixed-die cutting blade 20 with the second movable-die cutting blade 24. Therefore, in this case, it is not necessary to extend or sharpen the second movable-die cutting blade 24, and the blade strength of the second movable-die cutting blade 24 is ensured.

Even in the case where the arc cross-sectional portion 30 corresponding to the machining radius r of the machining tool is formed in the scrap-cutting blade 26, a portion corresponding to the scrap S2 of the arc cross-sectional portion 30 remaining outside the cutting line L of the product P, after the shearing process of the fixed-die cutting blade 20 with the first movable-die cutting blade 22, is small. In order to cut this, since the protrusion dimension of the extension of the second movable-die cutting blade 24 extended toward the moving-die scrap-cutting blade 28 side is reduced, and it is not necessary to sharpen the protruding tip thereof, it is possible to ensure the blade strength of the movable-die scrap-cutting blade extension.

In the embodiment of FIG. 2, in accordance with the latter, the scrap-cutting blade R-portion 36 composed of an arc cross-sectional portion 30 corresponding to the machining radius r of the machining tool is formed in the scrap-cutting blade 26 at the base end of the protruding scrap cutter 16, a movable-die scrap-cutting blade R-portion 38 for cutting the scraps S1 and S2 is formed at the movable-die scrap-cutting blade 28 by the shearing process with the scrap-cutting blade R-portion 36, and a movable-die cutting blade extension 40 is formed by projecting the second movable-die cutting blade 24 toward the movable-die scrap-cutting blade R-portion 38.

As a result, by the shearing process of the scrap-cutting blade R-portion 36 with the movable-die scrap-cutting blade R-portion 38, a scrap portion of the arc cross-sectional portion 30 corresponding to the machining radius r of the machining tool remains outside the product P with respect to the cutting line L after the shearing process of the fixed-die cutting blade 20 with the first movable-die cutting blade 22. The remaining scrap portion of the arc cross-sectional portion 30 is cut by the shearing process of the movable-die cutting blade extension 40 and the fixed-die cutting blade 20. As described above, and illustrated in FIG. 3, since the scrap portion of the substantially arc-shaped cross-sectional portion 30 remaining outside the cutting line L of the product P after the shearing process of the fixed-die cutting blade 20 and the first movable-die cutting blade 22 is small, and the protrusion dimension of the movable-die cutting blade extension 40 of the second movable-die cutting blade 24 for cutting this scrap portion is small, it is not necessary to sharpen the protruding tip thereof. Therefore, even when the second movable-die cutting blade 24 is extended toward the movable-die scrap-cutting blade 28, it is possible to ensure the blade strength of the movable-die cutting blade extension 40.

Further, in the embodiment of FIG. 2, the cutting blade of the movable-die cutting blade extension 40 is formed to protrude toward the fixed die 10 beforehand, and the accommodating recess 42 in which the protrusion of the movable-die cutting blade extension toward the fixed die 10 is accommodated at the time of shearing with the fixed die 10 of the second movable die 14 is formed in the scrap cutter 16. Thus, after the shearing process of the fixed-die cutting blade 20 and the first movable-die cutting blade 22, the scrap S2 portion of the arc cross-sectional portion 30 remaining outside the cutting line L of the product P is cut by the shearing process of the movable-die cutting blade extension 40 with the fixed-die cutting blade 20 together with the scrap S2 from the shearing process of the second movable-die cutting blade 24 with the fixed-die cutting blade 20. Since the arc cross-sectional portion 30 of the cut scrap S2 is accommodated in the accommodating recess 42 of the scrap cutter 16, interference between the scrap S2 and the scrap cutter 16 is suppressed. Further, since the scrap-cutting blade 26 of the scrap cutter 16 may be removed by the accommodation recess 42 for accommodating the protrusion of the second movable-die cutting blade 24 including the movable-die cutting blade extension 40 or the movable-die cutting blade extension 40 toward the fixed die 10, it is possible to ensure the cutting blade length of the scrap-cutting blade 26 and ensure the cutting blade strength thereof.

It is needless to say that the disclosure includes various embodiment and the like which are not described above. Therefore, the technical scope of the disclosure is defined only by the items which specify the disclosure in the scope of the claims considered appropriate based on the above description.

As described above, according to the disclosure, the scrap cutter can be cantilevered from the fixed die in a substantially horizontal direction to eliminate the need for a base separated from the fixed die, and at the same time, the cutting blade strength of the fixed die or the movable die, in particular, the cutting blade strength of the second movable-die cutting blade or an extension thereof can be ensured without hindering the cutting accuracy of the product. As a result, it is possible to smoothly eject scrap from the press machine and simplify the process of cutting out products with the press machine.

The invention claimed is:

1. A press die comprising:

a fixed die, a first movable die, and a second movable die configured to cut out a product from a metal plate member; and a scrap cutter configured to cut scrap that is not part of the product, wherein:

the scrap cutter and the fixed die are integrally formed and protrude in a cantilever manner in a substantially horizontal direction from the fixed die;

the scrap cutter comprises a scrap-cutting blade configured to cut the scrap;

the fixed die comprises a fixed-die cutting blade configured to cut the metal plate member at a predetermined cutting line of the product;

the first movable die comprises a first movable-die cutting blade configured to cut the metal plate member at the cutting line of the product by a shearing process with the fixed-die cutting blade, and a movable-die scrap-cutting blade configured to cut the scrap by a shearing process with the scrap-cutting blade;

the second movable die comprises a second movable-die cutting blade configured to cut the metal plate member at the cutting line of the product by a shearing process with the fixed-die cutting blade;

the fixed-die cutting blade is configured to have a fixed-die cutting blade relief portion formed near a base end of the protruding scrap cutter and recessed inward to the product side from the cutting line of the product, the fixed-die cutting blade relief portion including a substantially arc-shaped cross-sectional portion corresponding to a machining radius of a machining tool for forming the scrap cutter, and the first movable-die cutting blade comprises a movable-die cutting blade protrusion configured to cut the metal plate member inward to the product side from the cutting line of the product by a shearing process with the fixed-die cutting blade relief portion.

2. The press die according to claim 1, wherein in the scrap-cutting blade, a scrap-cutting blade rounded portion having a substantially circular arc-shaped cross-sectional portion corresponding to the machining radius of the machining tool is formed at a base end of the protruding scrap cutter;

the movable-die scrap-cutting blade comprises a movable-die scrap-cutting blade rounded portion configured to cut the scrap by a shearing process with the scrap-cutting blade rounded portion; and the second movable-die cutting blade comprises a movable cutting blade extension protruding toward the movable-die scrap-cutting blade rounded portion.

3. The press die according to claim 2, wherein at least a cutting blade of the movable-die cutting blade extension is formed to protrude from the fixed-die side in advance, and the scrap cutter has an accommodating recess in which a protrusion of the movable-die cutting blade, extending toward the fixed-die side, is accommodated upon a shearing process with the fixed die by the second movable die.

* * * * *